US005470064A

United States Patent [19]

Landry

[11] Patent Number: 5,470,064

[45] Date of Patent: Nov. 28, 1995

[54] GAME APPARATUS

[76] Inventor: Francis Landry, R.R. 1, 390 boul. Ste-Anne Est, Ste-Anne-des-Monts, Québec, Canada, G0E 2G0

[21] Appl. No.: 372,155

[22] Filed: Jan. 13, 1995

[51] Int. Cl.[6] ..... A63F 7/06

[52] U.S. Cl. ..... 273/85 A; 273/85 G; 273/118 A; 273/126 A

[58] Field of Search ..... 273/108, 118, 273/119, 123, 126, 85 R, 85 G, 85 A

[56] References Cited

U.S. PATENT DOCUMENTS

| | | | |
|---|---|---|---|
| 2,819,082 | 1/1958 | Peters | 273/85 A |
| 2,964,320 | 12/1960 | Lebrun | 273/85 A |
| 3,907,293 | 9/1975 | Werner | 273/85 A |
| 3,920,243 | 11/1975 | Santos, Sr. | 273/85 A |
| 4,007,932 | 2/1977 | Lebrun . | |
| 4,691,920 | 9/1987 | Murphy et al. | 273/85 A |
| 5,046,734 | 9/1991 | Laine . | |
| 5,060,945 | 10/1991 | Irvine . | |
| 5,222,735 | 6/1993 | Savage . | |

FOREIGN PATENT DOCUMENTS

| | | |
|---|---|---|
| 618405 | 4/1961 | Canada . |
| 702391 | 1/1965 | Canada . |
| 1098904 | 3/1955 | France . |
| 1118832 | 3/1956 | France . |
| 2175810 | 12/1986 | United Kingdom . |

*Primary Examiner*—Raleigh W. Chiu

*Attorney, Agent, or Firm*—Andrus, Sceales, Starke & Sawall

[57] ABSTRACT

Disclosed herein is an action game apparatus comprising: a game board having a playing surface for supporting a playing piece for movement thereon, the game board comprising: a peripheral railing delimiting the playing surface; the playing surface being generally rectangular, having opposite ends and comprising:

a goal mouth located at each the opposite end of the playing surface;

a plurality of playing figures for striking and propelling the playing piece on the playing surface, the playing figures being pivotally mounted, essentially orthogonally to the playing surface, the playing figures being mounted at predetermined locations on the playing surface; bidirectional pivotal motion generating structure connected to each the playing figure for selective pivotal movement thereof; the apparatus further comprising: first and second input structure capable of being actuated by a first and a second player respectively, the first and second input structure having a plurality of keys adapted to allow the first and second players to sequentially control any one of the plurality of playing figures, each the input structure being connected to the bidirectional pivotal motion generating structure for selectively actuating the pivotal motion generating structure associated with a selected playing figure and for selectively controlling the direction of pivotal movement of the bidirectional rotational motion generating structure.

14 Claims, 4 Drawing Sheets

GAME APPARATUS

FIELD OF THE INVENTION

The present invention relates to action and skill game apparatus and more particularly to a competitive game apparatus in which two players may selectively control any of a plurality of playing figures with the aim of propelling a playing piece into the adversary's goal.

BRIEF DESCRIPTION OF THE PRIOR ART

Mechanical games for simulating competitive sports are well known in the art. Many of these games simulate popular sports such as hockey, football or soccer.

Among the hockey simulation games there is usually provided planar playing surface onto which will readily slide a small puck-like playing piece, usually made of plastic material. Mounted on this playing surface are a plurality of mobile playing figures. Half of the playing figures are connected by mechanical linkage with control handles at one end of the playing surface and the other half are connected by mechanical linkage with control handles at the other end of the playing surface. With such arrangement, each player may manipulate the control handles to move his or her half of the playing figures.

Examples of such hockey games and other similar sports simulation games are provided in the U.S. patents enumerated in the table below:

| U.S. PAT. NO. | APPLICANT(s) | ISSUE DATE |
|---|---|---|
| 5,222,735 | Savage | June 29, 1993 |
| 5,060,945 | Irvine | Oct 29, 1991 |
| 5,046,734 | Laine | Sept 10, 1991 |
| 4,691,920 | Murphy et al. | Sept 08, 1987 |
| 4,007,932 | LeBrun | Feb 15, 1977 |
| 3,920,243 | Santos, Sr. | Nov 18, 1975 |
| 3,907,293 | Werner | Sept 23, 1975 |

These types of arrangements provide a somewhat good simulation of the actual sports such as hockey. However, when the playing piece is within the reach of a single playing figure, the player controlling this particular playing figure may take time to move the playing figure, thus slowing the game to the detriment of the opponent. Furthermore, during spirited play, mechanical linkages will often warp or otherwise become damaged. Also, this type of arrangement will not allow a player to practice alone since from one end of the playing surface it is only possible to control half of the playing figures.

There is therefore a need for an improved game apparatus which will overcome the difficulties associated with the prior art.

OBJECTS OF THE INVENTION

An object of the present invention is therefore to provide an improved game apparatus.

Another object of the invention is to provide an improved game apparatus allowing each player to selectively control any of a plurality of playing figures.

SUMMARY OF THE INVENTION

The invention provides an action game apparatus comprising: a game board having a playing surface for supporting a playing piece for movement thereon, the game board comprising: a peripheral railing delimiting the playing surface; the playing surface being generally rectangular, having opposite ends and comprising:

a goal mouth located at each the opposite end of the playing surface;

a plurality of playing figures for striking and propelling the playing piece on the playing surface, the playing figures being pivotally mounted, essentially orthogonally to the playing surface, the playing figures being mounted at predetermined locations on the playing surface; bidirectional pivotal motion generating means connected to each the playing figure for selective pivotal movement thereof; the apparatus further comprising: first and second input means capable of being actuated by a first and a second player respectively, the first and second input means having a plurality of keys adapted to allow the first and second players to sequentially control any one of the plurality of playing figures, each the input means being connected to the bidirectional pivotal motion generating means for selectively actuating the pivotal motion generating means associated with a selected playing figure and for selectively controlling the direction of pivotal movement of the bidirectional rotational motion generating means.

Another embodiment of the invention provides an action game apparatus comprising: a game board having a playing surface for supporting a playing piece for movement thereon, the game board comprising: a peripheral railing delimiting the playing surface; the playing surface being generally rectangular, having opposite ends and comprising:

a goal mouth located at each the opposite end of the playing surface;

a plurality of playing figures for striking and propelling the playing piece on the playing surface, the playing figures being mounted, essentially orthogonally to the playing surface, the playing figures being mounted at predetermined locations on the playing surface; the apparatus being further characterized in that: one of the playing figures is mounted for linear displacement on the playing surface, in front of and orthogonal to each of the goal mouths with the linear displacement having a range corresponding approximately to the width of the goal mouths; the remaining playing figures being mounted for pivotal movement relative to the playing surface;

bidirectional motion generating means connected to each the playing figure for selective movement thereof; the apparatus further comprising: first and second input means capable of being actuated by a first and a second player respectively, the first and second input means having a plurality of keys adapted to allow the first and second players to sequentially control any one of the plurality of playing figures, each the input means being connected to the bidirectional motion generating means for selectively actuating the bidirectional motion generating means associated with a selected playing figure and for selectively controlling the direction of movement of the bidirectional motion generating means.

Other features and advantages of the invention will become apparent to those of ordinary skill in the art upon review of the following detailed description, claims, and drawings.

DETAILED DESCRIPTION OF THE PREFERRED EMBODIMENT

Figure 1:
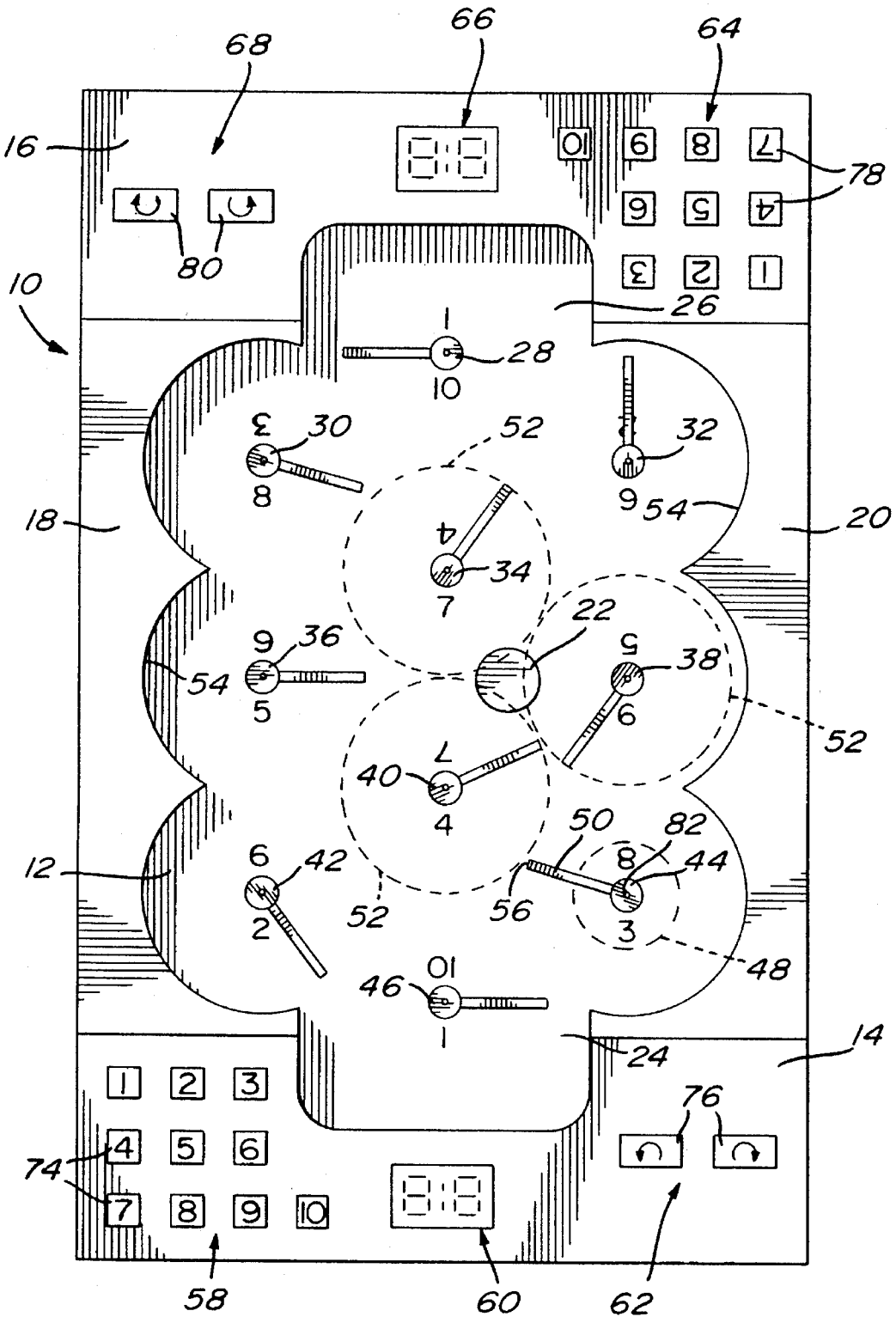
FIG. 1 is a schematic view of a first embodiment of a game board of the present invention.
Figure 2:
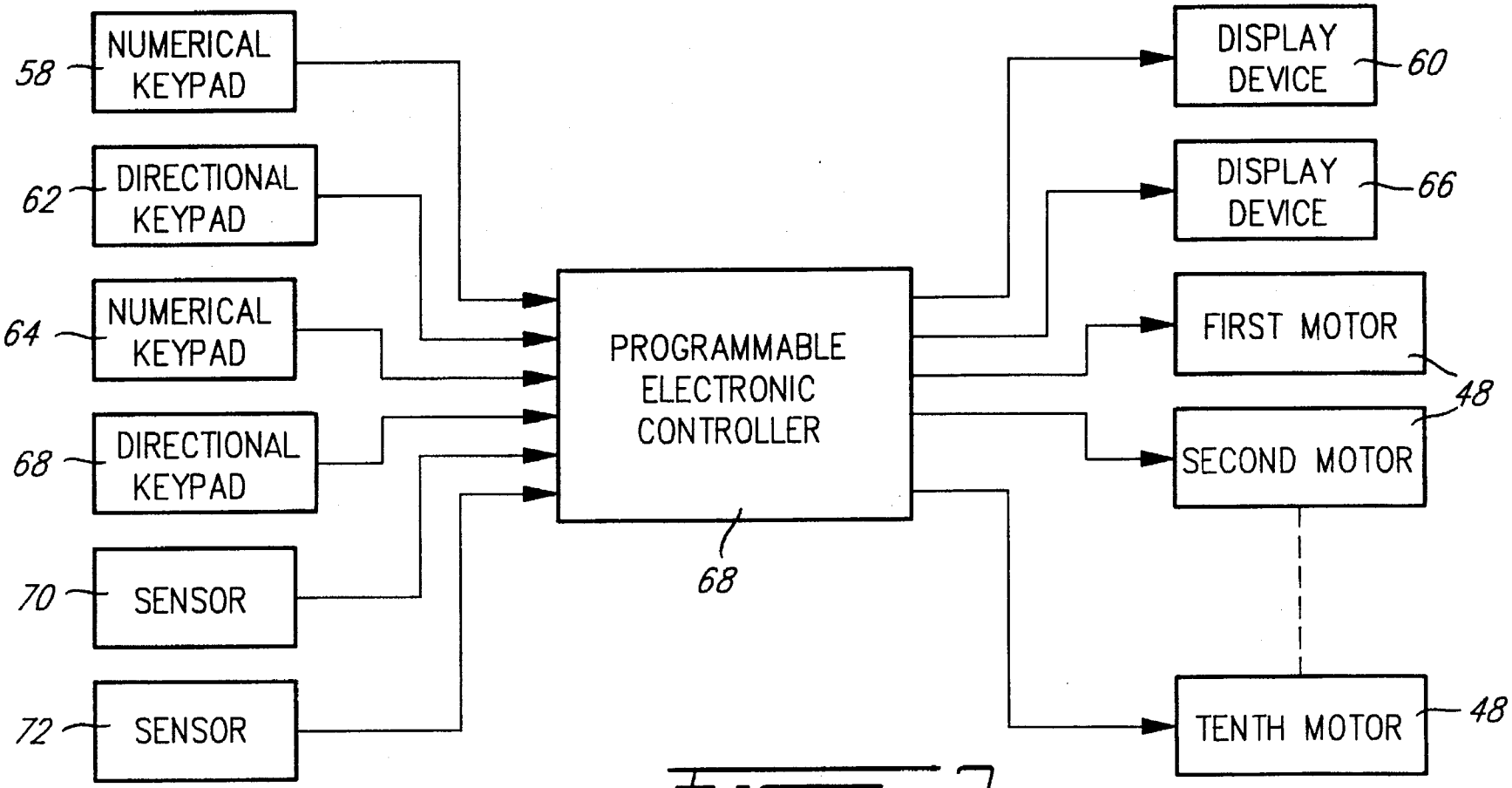
FIG. 2 is a block diagram of the interconnection of the various electrical component of the game board of FIG. 1.

Referring now to FIGS. 1 and 2 of the appended drawings, the first preferred embodiment of the present invention will be described.

Illustrated in FIG. 1 is an overhead schematic view of a game board 10 of rectangular shape, although the shape is not critical to the present invention. Game board 10 is divided in four general areas: a playing surface 12 formed on the upper surface of game board 10, a first keyboard 14 located at one longitudinal end of game board 10, a second keyboard 16 located at the opposite longitudinal end and a peripheral railing 18, 20 delimiting the area of playing surface 12.

The playing surface 12 is made of a smooth material to allow a playing piece 22 to readily slide thereon thus simulating the sliding motion of a hockey puck on ice. A pair of rectangular goal mouths 24 and 26 are provided at the opposite ends of the playing surface 12.

Also provided on the playing surface 12 are ten playing figures 28–46. It is to be understood that the number of playing figures is not critical to the present invention. Each of playing figures 28–46 is mounted on a vertical shafts 82 which traverse the playing surface 12 through a suitable bore. Each of shafts 82 is connected to a small electric motor 48 fixedly secured to the underside of playing surface 12. Accordingly, when any of electric motors 48 are energized, the corresponding playing figure 28–46 is rotated in the same direction of rotation as shaft 82.

Each playing figure 28–46 includes a substantially straight blade 50 extending in spaced parallel relationship above playing surface 12. The blade 50 has a predetermined length and is of course fixedly mounted to the playing figure 28–46 so as to rotate in unison with the playing figure 28–46.

In operation, i.e. when motors 48 are energized, the rotation of blades 50 of the playing figures 28–46 defines circular sweeping areas 52. If the playing piece 22 is in the sweeping area 52 covered by the blade 50 of a particular playing figure 28–46 it will be struck and propelled elsewhere on the playing surface 12. Each electric motor 48 can be separately controlled and energized to operate the particular playing figure 28–46 which is sought to be actuated to cause it to strike and propel the playing piece 22.

As illustrated in FIG. 1, the playing figures 28–46 are located at strategic locations on the playing surface 12 to keep the playing piece 22 within the reach of at least one playing figure 28–46. To do this, the playing figures 28–46 are placed so that their respective circular sweeping areas 52 are adjacent. Furthermore, the diameter of the playing piece 22 and the sweeping areas 52 is determined so that no blind spots exist where the playing piece 22 could become out of reach of all playing figures 28–46. In other words at areas of the playing surface 12, such as at the intersection of three sweeping areas 52, the diameter of the playing piece is large enough that it will necessarily overlap with at least one of sweeping areas 52.

Another feature of the present invention which allows playing piece 22 to always be within the reach of at least one sweeping area 52 is the peripheral railings 18,20 located on both sides of playing surface 12. Railings 18,20 are configured to keep the playing piece 22 within the reach of at least one playing figure 28–46 when playing piece 22 rests against or near a railing 18,20. Indeed, each peripheral railing 18,20 includes three circular cutaways 54 corresponding to the sweeping area 52 covered by the adjacent playing figures 28–46. The radius of the semi-circular cutaways 54 is slightly larger than the radius of the circular sweeping area 52 of the blade 50. This small difference in diameter ensures that there will be no contact between the tip 56 of the blade 50 and the circular cutaways 54. Furthermore, this diameter difference provides a large playing surface 12 for a given blade length and a given number of playing figures.

As illustrated in FIG. 1, two numbers are provided near each playing figure 28–46. These numbers are printed or otherwise marked on playing surface 12. For example numbers two (2) and nine (9) are provided near playing figure 42. When a player is at one end of the playing surface, he may easily read one of these two numbers, but the other number is upside down and partially hidden from view by the playing figure. The purpose of these numbers will become apparent from the description below.

The first keyboard 14 includes a numerical keypad 58 comprising ten numerical keys 74, a display device 60 and a directional keypad 62 comprising two directional keys 76. Similarly, the second keyboard 16 includes a numerical keypad 64 comprising ten numerical keys 78, a display device 66 and a directional keypad 68 comprising two directional keys 80.

The numerical keys 74,78 of each keypad 58,64 are used to select one of the ten playing figures 28–46. When a particular playing figure has been selected, one of the two directional keys 76,80 of keypads 62,68, respectively, may be pressed to choose the direction of rotation of the selected playing figure. The selected playing figure will rotate in the direction selected. It is to be noted that the numerical keypads 58 and 64 are provided with numbers corresponding to the numbers marked near each playing figure 28–46. Similarly, the directional keys 76,80 are provided with signs indicating the clockwise or counterclockwise direction.

For example, if the player facing the first keyboard 14 presses the numeral key 58 provided with the number four (4) and the directional key 62 provided with a clockwise sign, playing figure 40 will rotate clockwise. However, if the player facing the second keyboard 16 presses the numeral key 64 provided with the number four (4) and the directional key 68 provided with a clockwise sign, playing figure 34 will rotate clockwise.

It is to be noted that the numbers marked on the playing surface could be eliminated by placing the numerical keys 74,78 of the numerical keypads 58,64 in a configuration similar to the physical disposition of the playing figures 28–46 on the playing surface 12. This would, however, facilitate the game. The number array is preferred since it stimulates not only hand-eye coordination but mental acuity as well.

The display devices 60 and 66 provided on keyboards 14 and 16 respectively are used to indicate the score of the game.

Sensors 70 and 72 (see FIG. 2) are mounted near or in goal mouths 24 and 26, respectively, to detect the entry of playing piece 22 therein. As will be understood by one of ordinary skill in the art, many types of sensors may be used, as non limitative examples there can be mentioned:

mechanical sensors, magnetic sensors and optical sensors. In a preferred embodiment, the present invention uses a magnetic sensor which will detect passage of the playing piece 22 comprising a suitable metallic core which may be detected by a magnetic sensor.

Sensors 70 and 72 are electrically connected to a programmable electronic controller 68 (FIG. 2). This electronic controller 68 controls the two display devices 60 and 66. Furthermore, programmable electronic controller 68 receives the outputs of numerical keypads 58 and 64, and directional keypads 62 and 68.

Each electrical motors 48, used to rotate the playing figures 28–46 is also connected to the controller 68.

As will be understood by one of ordinary skill in the art of programmable electronic controllers, it is possible to modify many parameters controlled by controller 68. For example, the duration of rotation of electrical motors 48, when selected, may be programmed. Other operating characteristics and/or rules of the game may be easily changed by modifying the software of controller 68 without modifying the apparatus itself. For example, the playing figures 28 and 46, located in front of the goal mouths could be individually assigned and controllable by one player only so as to be used as goaltending playing figures.

Figure 3:
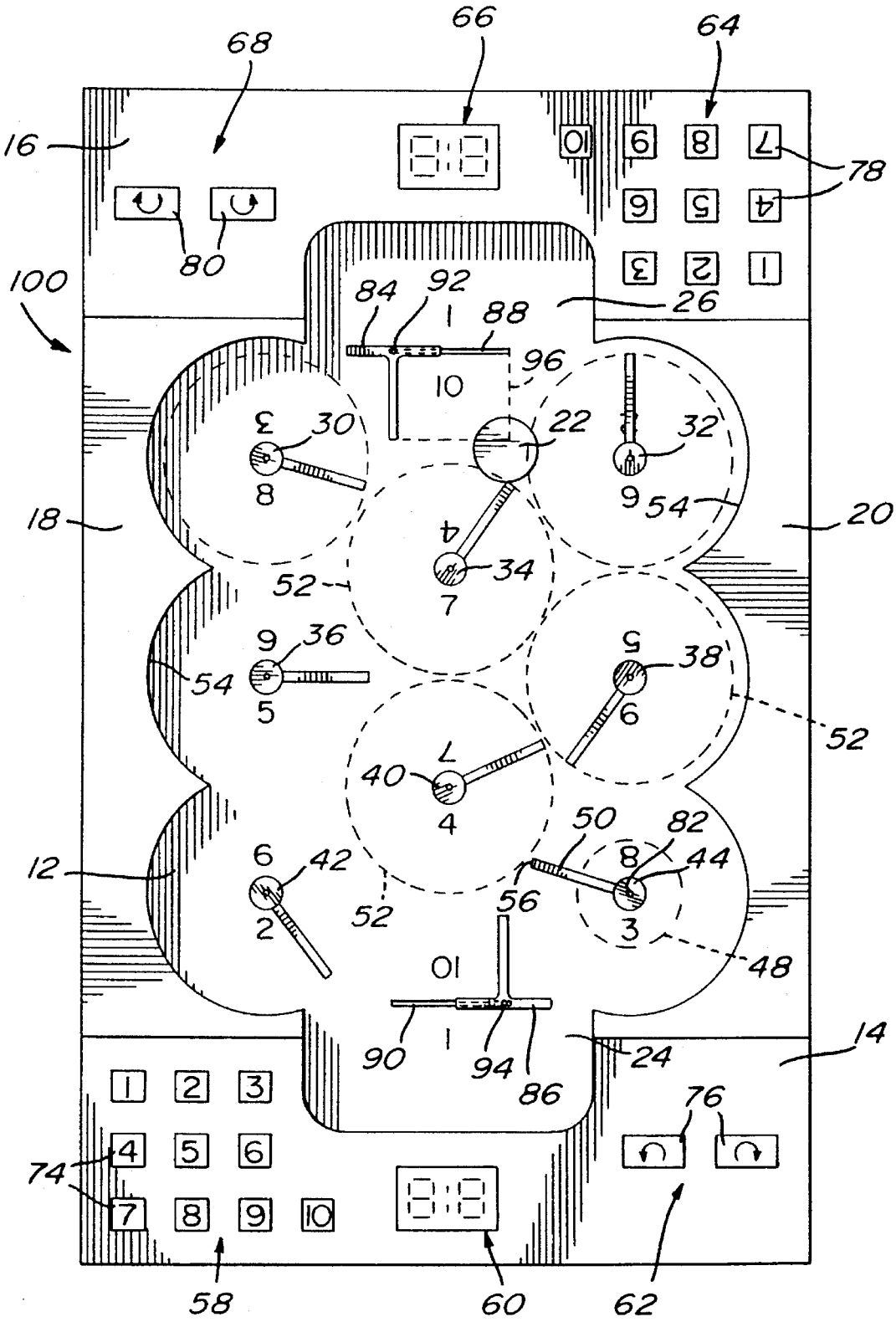
FIG. 3 is a schematic view of a second embodiment of a game board of the present invention.

Referring now to FIG. 3, a second preferred embodiment of the present invention will be described.

Illustrated in FIG. 3 is an overhead schematic view of a game board 100 which shares many of the characteristics of game board 10 previously discussed with references to FIGS. 1 and 2. These shared characteristics include the two keyboards and 16, the playing surface 12, the peripheral railing 18,20, the goal mouths 24 and 26 to name a few. It is to be noted that similar elements in different figures have the same reference numeral.

The main difference between game board 100 illustrated in FIG. 3 and game board 10 illustrated in FIG. 1 is the shape and the type of movement possible with playing figures 84 and 86 (FIG. 3) located in front of the goal mouths. Playing figures 84 and 86 are preferably individually assigned and controllable by one player only so as to be used as goaltending playing figures.

Playing figures 84 and 86 are T-shaped and can be moved from side to side in front of goal mouths 24 and 26. Indeed, transversal slots 88 and 90 are provided in the playing surface 12 to allow shafts 92 and 94 to traverse playing surface 12 and connect playing figures 84 and 86, respectively, to electrical motors mounted under playing surface 12.

It will be readily accomplished by one of ordinary skill in the art to adapt the circular motion of a conventional electrical motor to the type of side to side movement of playing figures 84 and 86 or to used other kinds of motion generators such as linear motors or solenoids to move the playing figures 84 and 86 from side to side.

When one of playing figures 84 and 86 is selected with numerical keys 74,78, and one of the directional keys 76,80 is pressed, the selected playing figure will be moved in the selected direction. FIG. 3 also illustrates the rectangular sweeping area 96 of playing figure 84. As illustrated, no blind spots exist where the playing piece 22 could become out of reach of all playing figures.

Figure 4:
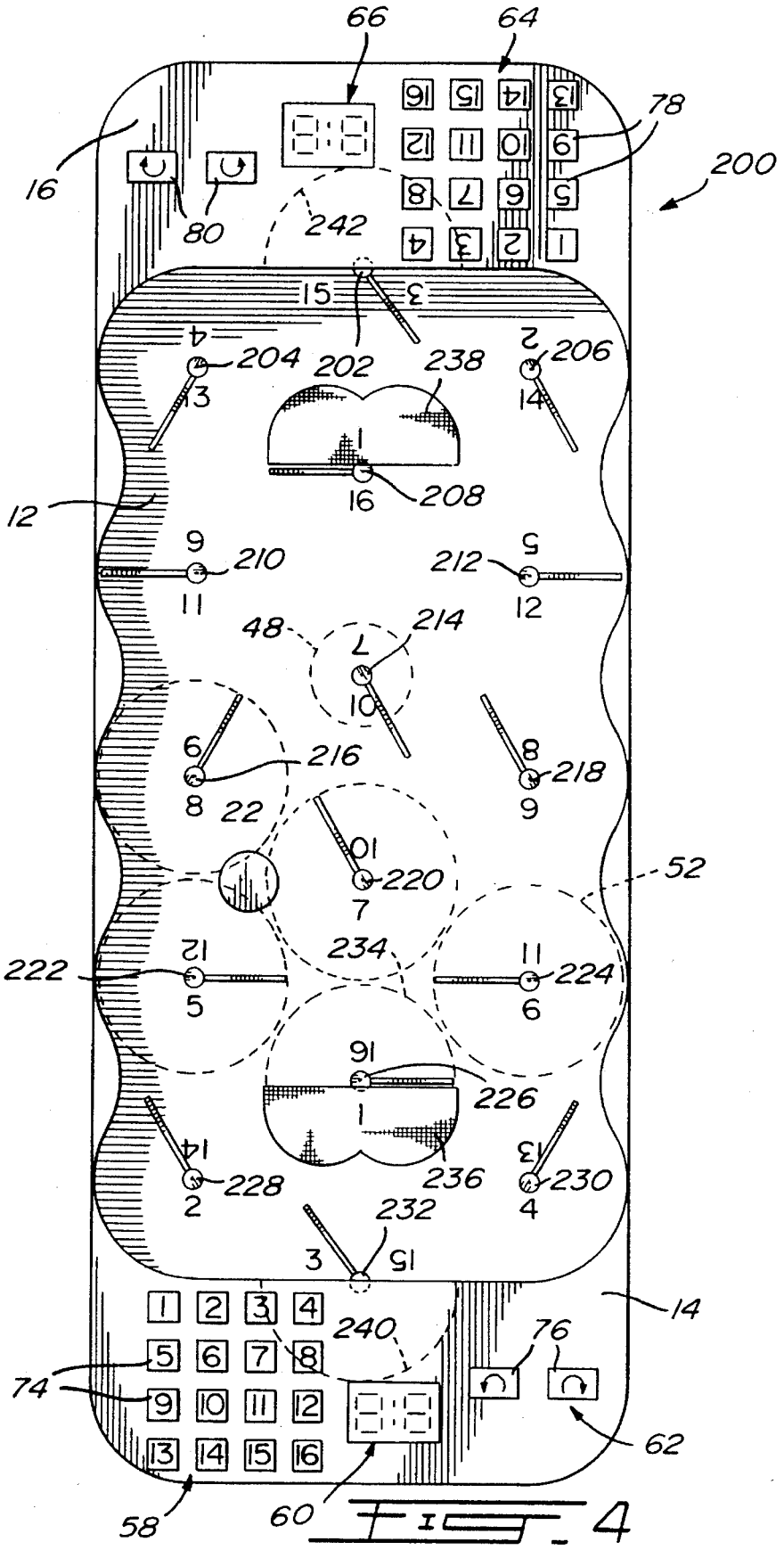
FIG. 4 is a schematic view of a third embodiment of a game board of the present invention.

Referring now to FIG. 4, a third preferred embodiment of the present invention will be described.

Illustrated in FIG. 4 is an overhead schematic view of a game board 200 which shares many of the characteristics of game board 10 previously discussed with references to FIGS. 1 and 2. These shared characteristics include the shape and rotational movement of the playing figures. It is to be noted that similar elements in different figures have the same reference numeral.

FIG. 4 illustrates a game board having sixteen playing figures 202–232. As illustrated in FIG. 4, no blind spots exist where the playing piece 22 could become out of reach of all playing figures.

Playing FIGS. 208 and 226 are preferably individually assigned and controllable by one player only so as to be used as goaltending playing figures. These goaltending playing figures may only execute a half rotation to thereby define semi-circular sweeping areas 234 in front of goals 236 and 238.

A major difference between game board 200 and game board 10 is the shape and position of the goals 236 and 238. Indeed, goals 236 and 238 are shaped as conventional hockey goals and are positioned on the playing surface 12 so that the playing piece 22 may go behind them.

There are many ways to retrieve the playing piece 22 once it as entered one of the goals 236 or 238. For example, an aperture large enough to accommodate the playing piece 22 could be made in the playing surface 12 under goals 236 and 238.

Playing figures 202 and 232 are positioned at the edge of playing surface 12. Semi-circular walls 240 and 242 (shown in dotted lines) are provided to keep the playing piece 22 within the reach of playing figures 202 and 232, respectively.

Of course, the numerical keypads 58 and 64 comprise sixteen numerical keys to control the sixteen playing figures 202 to 232.

Although the present invention has been described hereinabove by way of a preferred embodiment thereof, this embodiment can be modified at will, within the scope of the appended claims, without departing from the spirit and nature of the subject invention.

What is claimed is:

1. An action game apparatus comprising:

a game board having a playing surface for supporting a playing piece for movement thereon, said game board comprising:

a peripheral railing delimiting said playing surface;

said playing surface being generally rectangular, having opposite ends and comprising:

a goal mouth located at each said opposite end of said playing surface;

a plurality of playing figures for striking and propelling said playing piece on said playing surface, said playing figures being pivotally mounted, essentially orthogonal to said playing surface, said playing figures being mounted at predetermined locations on said playing surface;

bidirectional pivotal motion generating means connected to each said playing figure for selective pivotal movement thereof;

said apparatus further comprising:

first and second input means capable of being actuated by a first and a second player respectively, said first and second input means having a plurality of keys adapted to allow said first and second players to sequentially control any one of said plurality of playing figures, each said input means being connected to said bidirectional pivotal motion generating means for selectively actuating the pivotal motion generating means associated with a selected playing figure and for selectively controlling the direction of pivotal movement of said bidirectional rotational motion generating means.

2. An action game apparatus as described in claim 1, wherein said predetermined mounting locations of said playing figures are determined so as to allow at least one playing piece to be in pivotal movement range for striking and propelling said playing piece elsewhere on said playing surface.

3. An action game apparatus as described in claim 1, wherein said peripheral railing being configured so as to allow said playing piece to be in pivotal movement range of at least one of said playing figures to strike and propel said playing piece elsewhere on said playing surface.

4. An action game apparatus as described in claim 3, wherein said peripheral railing comprises adjacent arcuate sections so as to essentially limit said playing surface to the pivotal movement range of said playing figures.

5. An action game apparatus as described in claim 1, wherein said first and second input means are keyboards located at each said opposite ends of said game board.

6. An action game apparatus as described in claim 1, further comprising:

sensor means for detecting the entry of said playing piece into said goal mouths, display means associated with said sensor means to display the entry of said playing piece in said goal mouths.

7. An action game apparatus as described in claim 6, further comprising:

counting means associated with said sensor means for counting the number of entries of said playing piece into each said goal mouths, score display means associated with said counting means for displaying said number of entries of said playing piece into each goal mouths.

8. An action game apparatus as described in claim 1, further comprising:

sensor means for detecting the entry of said playing piece into said goal mouths, display means associated with said sensor means to display the entry of said playing piece in said goal mouths.

9. An action game apparatus as described in claim 8, further comprising:

counting means associated with said sensor means for counting the number of entries of said playing piece into each said goal mouths, score display means associated with said counting means for displaying said number of entries of said playing piece into each goal mouths.

10. An action game apparatus comprising:

a game board having a playing surface for supporting a playing piece for movement thereon, said game board comprising:

a peripheral railing delimiting said playing surface;

said playing surface being generally rectangular, having opposite ends and comprising:

a goal mouth located at each said opposite end of said playing surface;

a plurality of playing figures for striking and propelling said playing piece on said playing surface, said playing figures being mounted, essentially orthogonally to said playing surface, said playing figures being mounted at predetermined locations on said playing surface;

the apparatus being further characterized in that:

one of said playing figures is mounted for linear displacement on said playing surface, in front of each of said goal mouths with said linear displacement having a range corresponding approximately to the width of said goal mouths;

the remaining playing figures being mounted for pivotal movement relative to said playing surface;

bidirectional motion generating means connected to each said playing figure for selective movement thereof;

said apparatus further comprising:

first and second input means capable of being actuated by a first and a second player respectively, said first and second input means having a plurality of keys adapted to allow said first and second players to sequentially control any one of said plurality of playing figures, each said input means being connected to said bidirectional motion generating means for selectively actuating the bidirectional motion generating means associated with a selected playing figure and for selectively controlling the direction of movement of said bidirectional motion generating means.

11. An action game apparatus as described in claim 10, wherein said predetermined mounting locations of said playing figures are determined so as to allow at least one playing piece to be in pivotal movement range for striking and propelling said playing piece elsewhere on said playing surface.

12. An action game apparatus as described in claim 10, wherein said peripheral railing being configured so as to allow said playing piece to be in pivotal movement range of at least one of said playing figures to strike and propel said playing piece elsewhere on said playing surface.

13. An action game apparatus as described in claim 12, wherein said peripheral railing comprises adjacent arcuate sections so as to essentially limit said playing surface to the pivotal movement range of said playing figures.

14. An action game apparatus as described in claim 10, wherein said first and second input means are keyboards located at each said opposite ends of said game board.

* * * * *